US009311832B2

(12) United States Patent
Kanai

(10) Patent No.: US 9,311,832 B2
(45) Date of Patent: Apr. 12, 2016

(54) PLATE-LIKE MEMBER MOUNTING DEVICE

(71) Applicant: Shoichi Kanai, Kyoto (JP)

(72) Inventor: Shoichi Kanai, Kyoto (JP)

(73) Assignee: Shoichi Kanai, Kyoto (JP)

( * ) Notice: Subject to any disclaimer, the term of this patent is extended or adjusted under 35 U.S.C. 154(b) by 123 days.

(21) Appl. No.: 13/870,168

(22) Filed: Apr. 25, 2013

(65) Prior Publication Data

US 2014/0319311 A1 Oct. 30, 2014

(51) Int. Cl.

| | |
|---|---|
| ***G09F 7/18*** | (2006.01) |
| ***G09F 15/00*** | (2006.01) |
| *G09F 13/04* | (2006.01) |

(52) U.S. Cl.

CPC ..... *G09F 7/18* (2013.01); *G09F 15/0012* (2013.01); *G09F 2007/1843* (2013.01); *G09F 2013/0445* (2013.01)

(58) Field of Classification Search

CPC ..... G06F 7/18; G06F 15/0012; G06F 2007/1843; G06F 2013/0445; F16F 7/12

USPC ..... 248/580, 562, 610, 611, 612, 613, 317, 248/342, 343, 344; 52/94, 518, 483.1, 52/746.1, 747.1, 489.1, 506.06, 506.07, 52/506.09, 664, 669; 40/578, 718

See application file for complete search history.

(56) References Cited

U.S. PATENT DOCUMENTS

| | | | | |
|---|---|---|---|---|
| 1,350,349 | A * | 8/1920 | Walther | 52/402 |
| 2,250,411 | A * | 7/1941 | Baker | 52/506.09 |
| 2,454,012 | A * | 11/1948 | Sears | 248/311.2 |
| 3,834,106 | A * | 9/1974 | Astedt et al. | 52/506.07 |
| 4,110,948 | A * | 9/1978 | Maier, Jr. | 52/402 |
| 4,599,831 | A * | 7/1986 | Magaha, Jr. | 52/98 |
| 4,769,965 | A * | 9/1988 | Shaub | 52/506.07 |
| 4,920,719 | A * | 5/1990 | Shaub et al. | 52/506.08 |
| 5,377,463 | A * | 1/1995 | Howe | 52/200 |
| 7,694,464 | B2 * | 4/2010 | Garcia et al. | 52/94 |
| 7,895,803 | B2 * | 3/2011 | Downey et al. | 52/511 |
| 2004/0099623 | A1 * | 5/2004 | Kurtz et al. | 211/85.17 |
| 2008/0258028 | A1 * | 10/2008 | Garcia et al. | 248/221.11 |
| 2008/0291618 | A1 * | 11/2008 | Sheng | 361/685 |
| 2010/0130055 | A1 * | 5/2010 | Liang et al. | 439/532 |

FOREIGN PATENT DOCUMENTS

| | | | |
|---|---|---|---|
| JP | 58-63411 | U | 4/1983 |
| JP | 7-331817 | A | 12/1995 |
| JP | 2001-151160 | A | 6/2001 |

OTHER PUBLICATIONS

Mitsubishi, Mitsubishi Fluorescent Lamp Apparatus (Ceiling Embedded Apparatus) Type FY2544X Operation Manual including partial English translation.

Office Action mailed Jun. 9, 2015, corresponding to Japanese patent application No. 2011-237849.

* cited by examiner

*Primary Examiner* — Nkeisha Smith

(74) *Attorney, Agent, or Firm* — Hauptman Ham, LLP

(57) ABSTRACT

A plate-like member mounting device 1 supports a front panel 14 with use of panel supporting portions 23 and a damper 12 of a base panel 11. The damper 12 is subjected to first-level deformation with a small thrust in the vertical direction, and after that, is subjected to second-level deformation with a large thrust. The damper 12 is deformed in the first direction with a thrust in a first direction, and supports the front panel 14 from a back surface side of the front panel 14 while the damper 12 is being subjected to the first-level deformation.

10 Claims, 11 Drawing Sheets

FIG. 3

| | EXAMPLES OF DAMPER | | | | | | | | | |
|---|---|---|---|---|---|---|---|---|---|---|
| TYPE | A | B | C | D | E | F | G | H | I | J |
| SHAPE | | | | | | | | | | |
| CHANGE IN THRUST FOR VERTICALLY CHANGING DAMPER | TWO STEPS | TWO STEPS | TWO STEPS | TWO STEPS | SMALL INCREASE | SMALL INCREASE | TWO STEPS | TWO STEPS | TWO STEPS | ALMOST CONSTANT |
| HORIZONTAL DEFORMABILITY | GOOD | GOOD | GOOD | GOOD | BAD | BAD | GOOD | GOOD | GOOD | GOOD |
| RESTORATION | GOOD | GOOD | GOOD | GOOD | GOOD | GOOD | BAD | BAD | BAD | GOOD |
| SUITABILITY | SUITABLE | SUITABLE | SUITABLE | SUITABLE | UNSUITABLE | UNSUITABLE | UNSUITABLE | UNSUITABLE | UNSUITABLE | UNSUITABLE |

PLATE-LIKE MEMBER MOUNTING DEVICE

TECHNICAL FIELD

The present invention relates to plate-like member mounting devices for mounting various plate-like members, such as cover panels of lighting apparatuses and advertising signs.

BACKGROUND ART

For example, a panel such as an advertising sign is generally fixed, with use of a screw or a special metal fitting, to a predetermined target member on which the panel is to be mounted.

For example, a cover panel of a lighting apparatus is mounted onto a lighting apparatus main body with use of a large number of parts as described in, for example, Non-Patent Literature 1. FIG. 11 is an exploded perspective view disclosed in Non-Patent Literature 1 and illustrates a conventional lighting apparatus for a fluorescent lamp.

As illustrated in FIG. 11, a lighting apparatus 500 is configured such that a lighting apparatus main body 501 is fixed to a ceiling with use of a bolt and a nut, a reflective plate 502 is fixed to the lighting apparatus main body 501 with use of a screw, and a cover member 503 is mounted onto the lighting apparatus main body 501 with use of four v-shaped springs 504. The cover member 503 is configured such that a frame member 506, which surrounds a cover 505 on a panel, supports the cover 505.

FIG. 12 is a perspective view illustrating a mounting structure of the cover member 503 onto the lighting apparatus main body 501. Mounting of the cover member 503 onto the lighting apparatus main body 501 is performed by a worker, as illustrated in FIG. 12, by fitting the v-shaped springs 504 provided on the frame member 506 into respective spring mounted sections 507 provided on the lighting apparatus main body 501.

CITATION LIST

Non-Patent Literature

Non-Patent Literature 1

"MITSUBISHI Fluorescent Lamp Apparatus (Ceiling Embedded Apparatus) Type FY2544X operation manual", Japan, page 2

SUMMARY OF INVENTION

Technical Problem

However, for example, in a case where an advertising sign is fixed, with use of a screw or a special metal fitting, to a predetermined target member on which the advertising sign is to be mounted, a worker has to do troublesome works to mount and detach the advertising sign. Therefore, it is not easy, for example, to replace a sign which is placed on a passageway of a station within a short-term cycle.

Further, for example, in a case where a fluorescent lamp in the lighting apparatus 500 is replaced with a new one, a worker must detach the cover member 503 by detaching the plurality of springs 504 provided on the frame member 506 from the respective spring mounted sections 507 of the lighting apparatus main body 501. This work is also troublesome for a worker. In addition, a structure for mounting the cover 505 onto the lighting apparatus main body 501 needs a large number of parts and becomes complicated, because the structure needs works such as providing the frame member 506 around the cover 505, mounting the plurality of springs 504 onto the frame member 506, and fitting the springs 504 into the respective spring mounted sections 507 of the lighting apparatus main body 501.

Therefore, an object of the present invention is to provide a plate-like member mounting device which allows a plate-like member to be easily mounted and detached with a simple configuration.

Solution to Problem

In order to attain the above object, a plate-like member mounting device of the present invention, on which a plate-like member is mounted, the plate-like member mounting device includes: a base member; and at least one elastic member, wherein: the base member has a base portion and supporting portions; the base portion has an elastic member fixed surface to which the at least one elastic member is fixed; the supporting portions (I) are located on both sides of the elastic member fixed surface in a first direction which is in parallel with the elastic member fixed surface, the supporting portions being located in front of the elastic member fixed surface so as to have a space therebetween in the first direction, which space is shorter than a length of the plate-like member in the first direction, and (II) support the plate-like member from a front surface side thereof; and the at least one elastic member (i) is fixed to the elastic member fixed surface, (ii) is subjected to first-level deformation in the vertical direction in a case where the at least one elastic member receives a first-level thrust of a vertical direction, (iii) after the first-level deformation, is further subjected to second-level deformation in the vertical direction in a case where the at least one elastic member receives a second-level thrust in the vertical direction, which second-level thrust is larger than the first-level thrust, (iv) is deformed in the first direction in a case where the at least one elastic member receives a thrust in the first direction, and (v) supports the plate-like member from a back surface side of the plate-like member while the at least one elastic member is being subjected to the first-level deformation.

Advantageous Effects of Invention

According to the configuration of the present invention, in a work of moving the plate-like member in the first direction in order to mount the plate-like member, a back surface of the plate-like member or an elastic member abutted surface of the base portion is abutted against the elastic member, however, in a case where a thrust in the first direction is applied to the elastic member, the elastic member is deformed in the first direction. Therefore, it is possible to easily perform the work. It is further possible to easily detach the plate-like member by performing inversely the work. With this simple configuration, the plate-like member can be easily mounted and detached.

In a case where the plate-like member is located at a predetermined location, the elastic member is restored to an original state from such deformation in the first direction. Therefore, a front surface of the plate-like member is supported by supporting portions on the both sides, and the back surface is supported by the plate-like member which is subjected to first-level deformation. This makes it possible to steadily hold the plate-like member.

BRIEF DESCRIPTION OF DRAWINGS

FIG. 3 is an explanatory view showing examples of the elastic members of FIG. 2 and results of examining whether or not each elastic member is suitable as a plate-like member mounting device.

Figure 2:
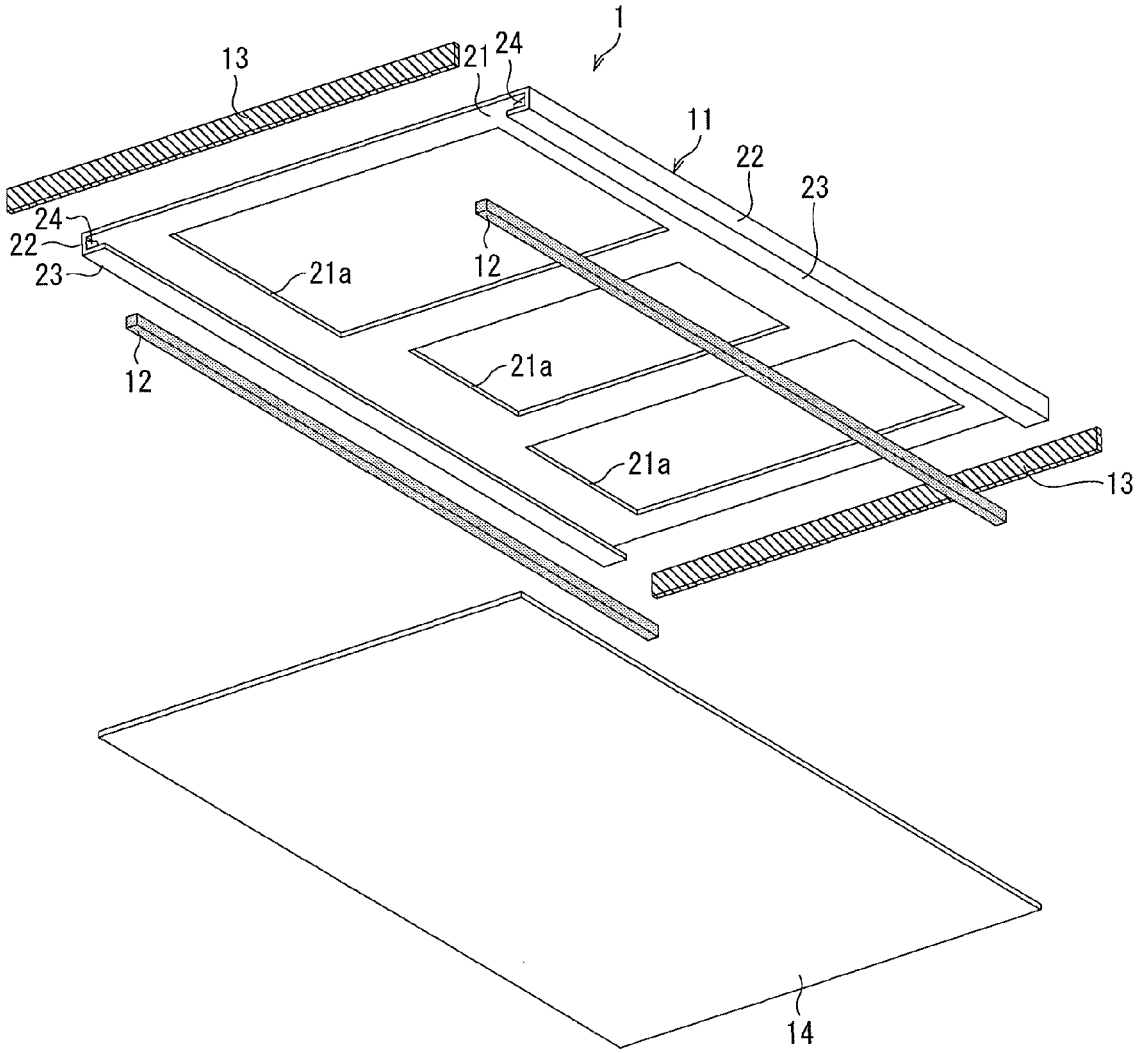
FIG. 2 is an exploded perspective view of the plate-like member mounting device of FIG. 1.
Figure 5:
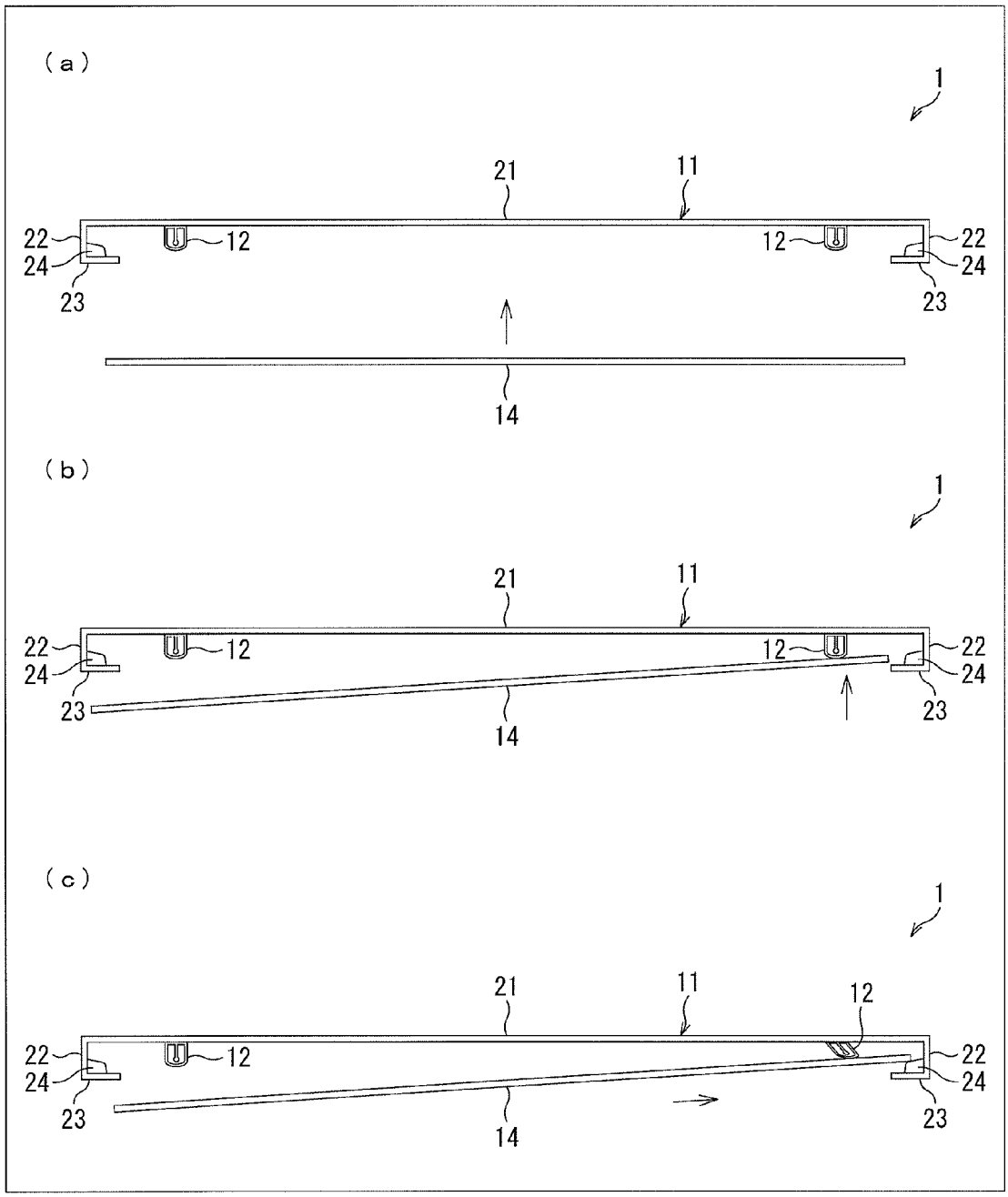

(a) of FIG. 5 is an explanatory view illustrating the plate-like member mounting device of FIG. 2, specifically, a state in which a front panel is detached from a base panel, (b) of FIG. 5 is an explanatory view illustrating an initial state of a work in which one of edge portions of a front panel is inserted into one of end regions of the base panel, and (c) of FIG. 5 is an explanatory view illustrating a working state in which the one of the edge portions of the front panel is inserted into the one of the end regions of the base panel.

Figure 6:
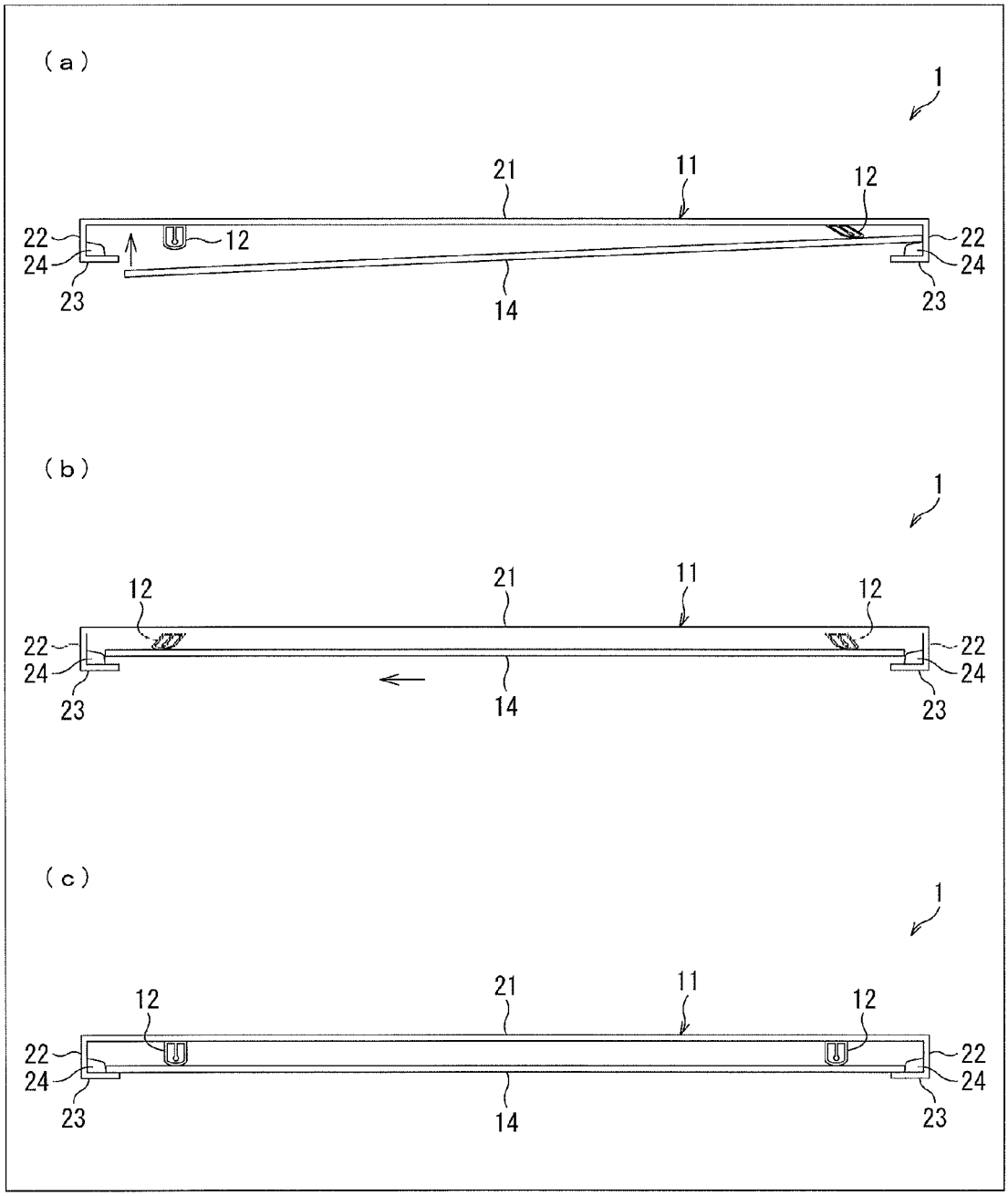

(a) of FIG. 6 is an explanatory view illustrating completion of the work, in which the one of the edge portions of the front panel is inserted into the one of the end regions of the base panel, from the state of (c) of FIG. 5, (b) of FIG. 6 is an explanatory view illustrating a state in which the both edge portions are inserted into the front panel of the base panel, and (c) of FIG. 6 is an explanatory view illustrating completion of locating the front panel at a panel location in the base panel.

Figure 7:
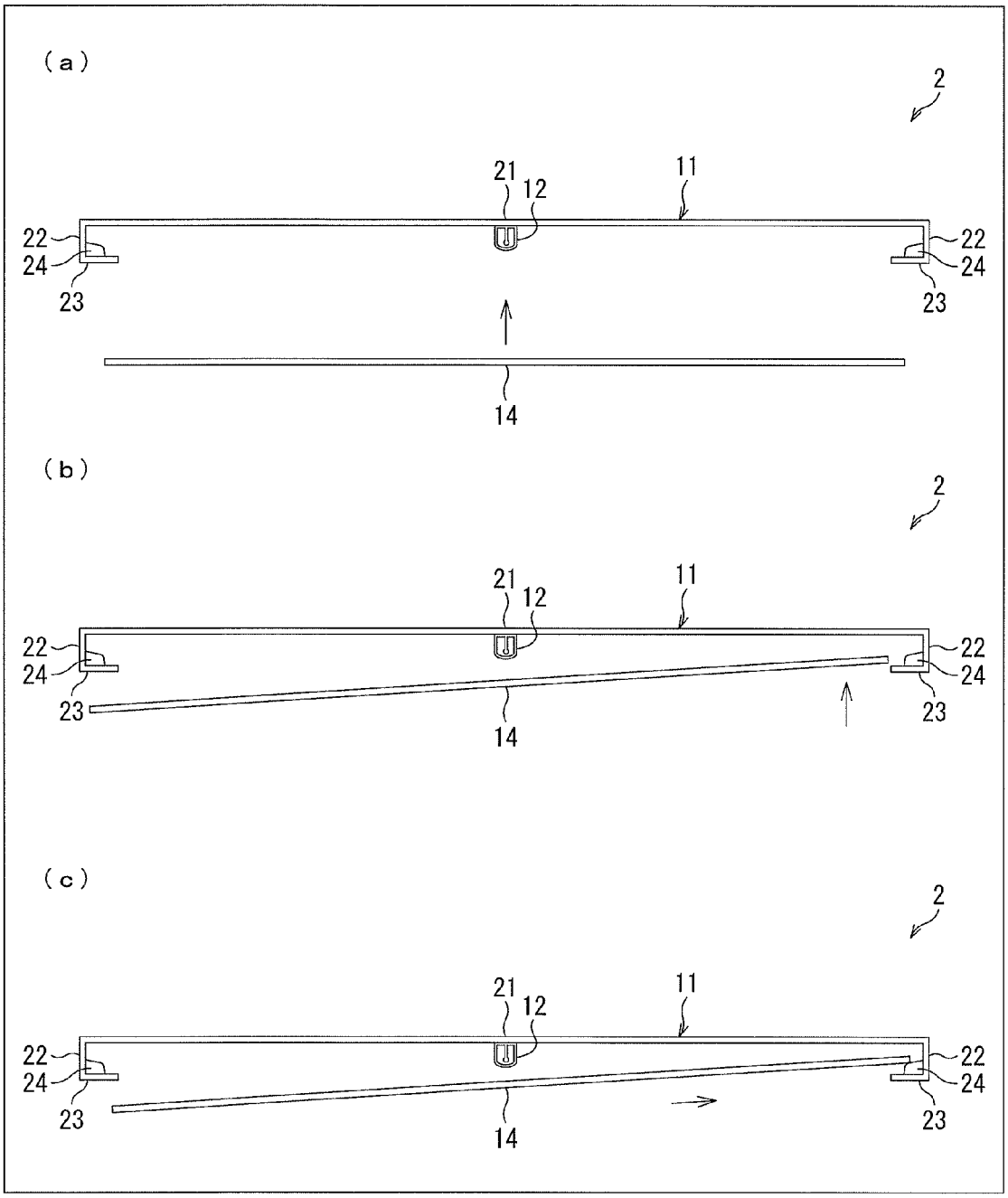

(a) of FIG. 7 is an explanatory view illustrating a plate-like member mounting device of another embodiment of the present invention, specifically, a state in which a front panel is detached from a base panel, (b) of FIG. 7 is an explanatory view illustrating an initial state of a work in which one of edge portions of a front panel is inserted into one of end regions of the base panel, and (c) of FIG. 7 is an explanatory view illustrating a working state in which the one of the edge portions of the front panel is inserted into the one of the end regions of the base panel.

Figure 8:
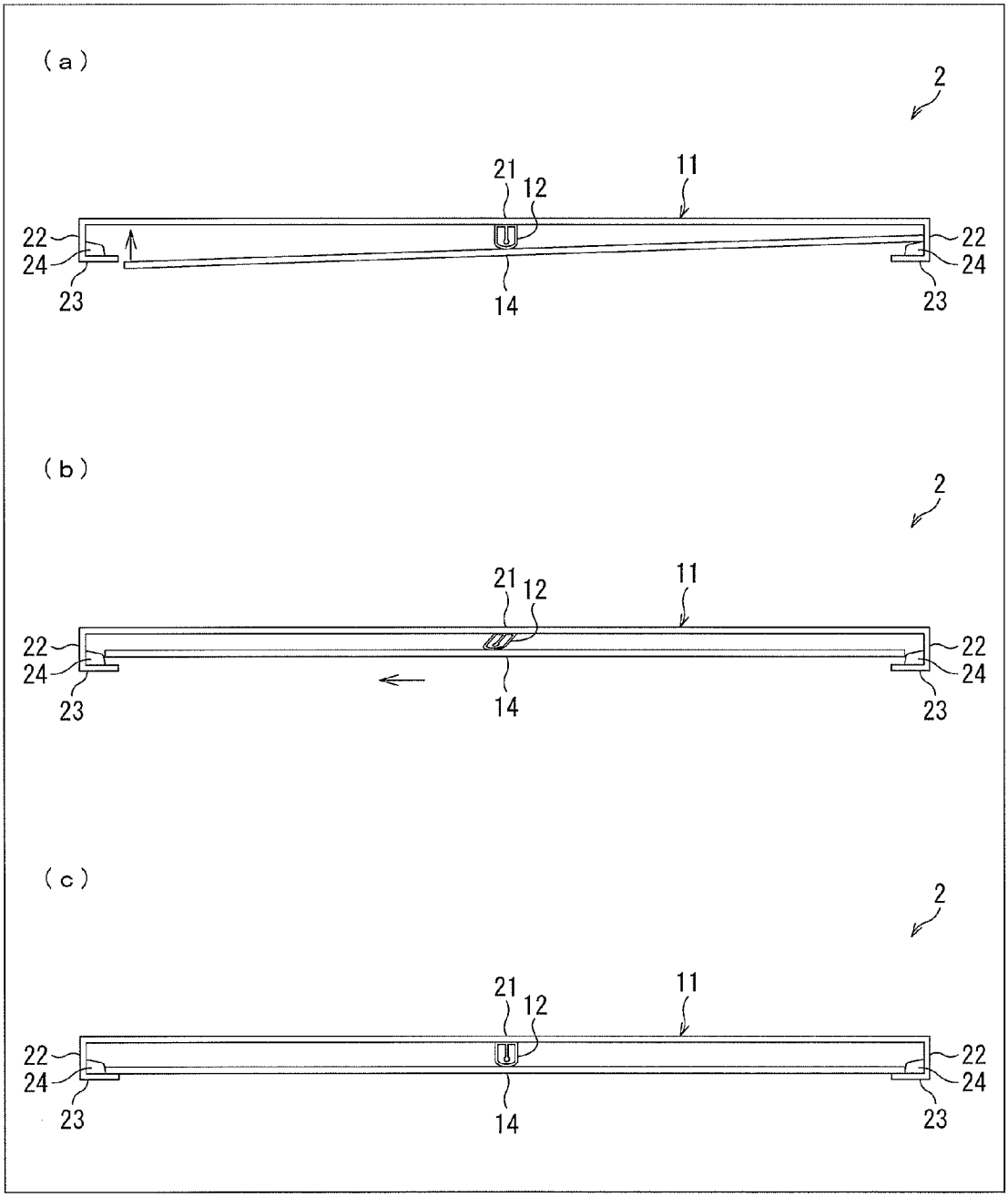

(a) of FIG. 8 is an explanatory view illustrating completion of the work, in which the one of the edge portions of the front panel is inserted into the one of the end regions of the base panel, from the state of (c) of FIG. 7, (b) of FIG. 8 is an explanatory view illustrating a state in which the both edge portions are inserted into the front panel of the base panel, and (c) of FIG. 8 is an explanatory view illustrating completion of locating the front panel at a panel location in the base panel.

Figure 9:
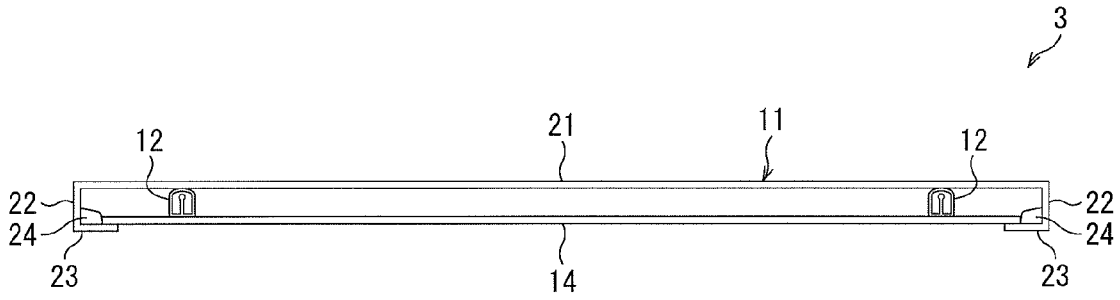

FIG. 9 illustrates another example of a plate-like member mounting device in an embodiment of the present invention, and is an explanatory view illustrating a state in which, in the plate-like member mounting device, a front panel providing two elastic members is mounted onto a base panel.

Figure 10:
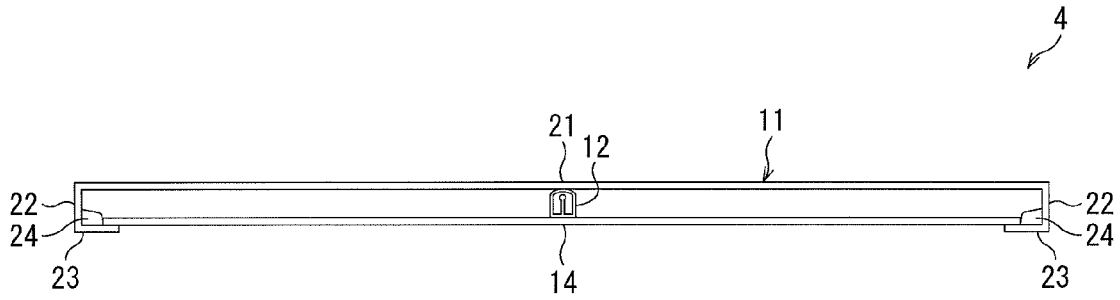

FIG. 10 illustrates still another example of a plate-like member mounting device in an embodiment of the present invention, and is an explanatory view illustrating a state in which, in the plate-like member mounting device, a front panel providing a single elastic member is mounted onto a base panel.

Figure 11:
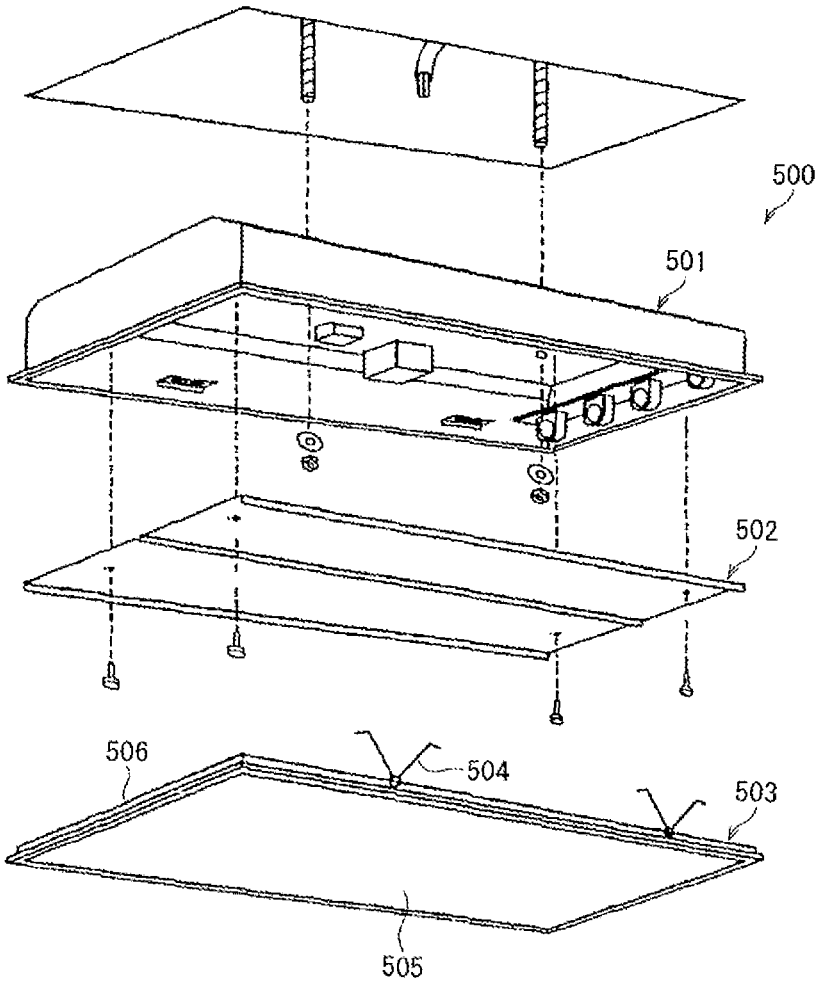
FIG. 11 (Prior Art)

FIG. 11 is an exploded perspective view of a conventional lighting apparatus for a fluorescent lamp.

Figure 12:
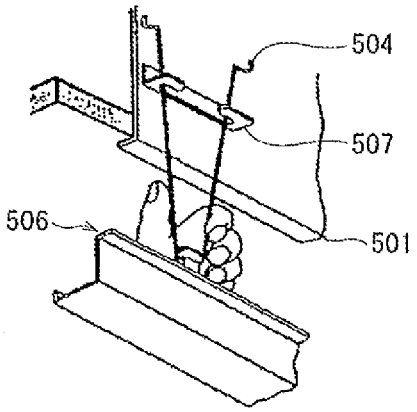
FIG. 12 (Prior Art)

FIG. 12 is a perspective view showing a mounting structure in which the cover member of FIG. 11 is mounted onto a lighting apparatus main body.

DESCRIPTION OF EMBODIMENTS

[Embodiment 1]

The following description will discuss an embodiment of the present invention with reference to drawings.

Figure 1:
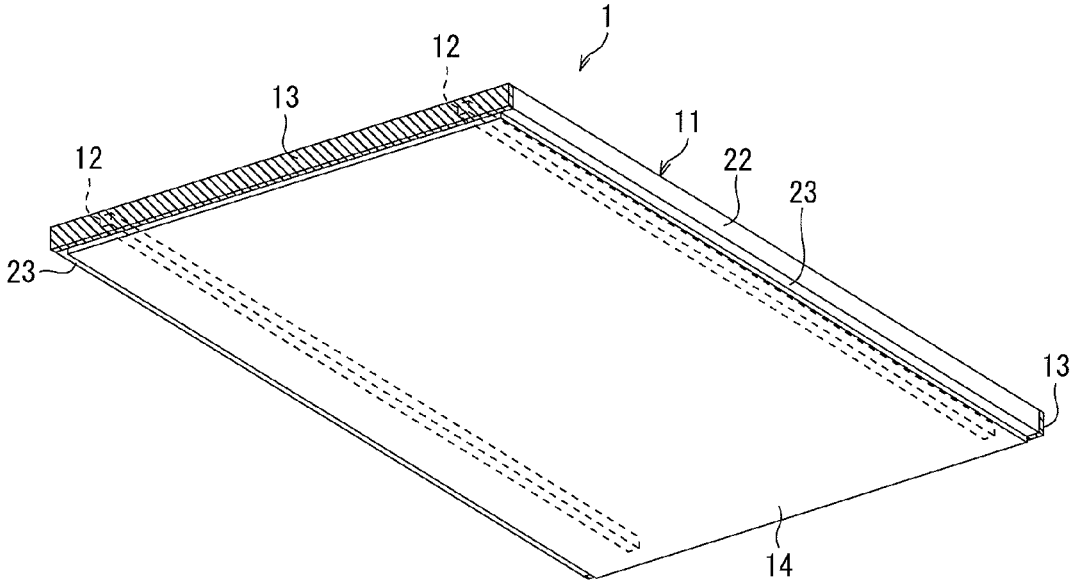
FIG. 1 is a perspective view illustrating a plate-like member mounting device in an embodiment of the present invention.

FIG. 1 is a perspective view illustrating a plate-like member mounting device 1 in an embodiment of the present invention. FIG. 2 is an exploded perspective view of the plate-like member mounting device 1 of FIG. 1. The plate-like member mounting device 1 can be provided on, for example, a ceiling surface, a wall surface of a building, or a certain apparatus or structure for supporting the plate-like member mounting device 1.

As illustrated in FIG. 1 and FIG. 2, the plate-like member mounting device 1 is made up of a base panel (base member) 11, a damper (elastic member) 12, a side panel 13, and a front panel (plate-like member) 14. The base panel 11, the side panel 13, the front panel 14 may be made of resin, metal, or another material as necessary. The damper 12 is made from various kinds of rubbers, resins, or any other materials having an elasticity function.

The base panel 11 has a base portion 21, rising portions 22, panel supporting portions (supporting portions) 23, and guiding portions (guiding member) 24.

In this embodiment, the base portion 21 is formed to have a planar shape and has a plurality of cut-out openings 21*a* in order to reduce its weight.

The rising portions 22 are formed to vertically rise from both edge portions in a longitudinal or lateral direction of the base portion 21 toward a front of the base portion 21. In this embodiment, the rising portions 22 are formed at the both edge portions in the longitudinal direction.

A height of the rising portions 22 is appropriately set depending on usage of the plate-like member mounting device 1. For example, in a case where the plate-like member mounting device 1 is used only to hold the front panel 14, the height of the rising portions 22 may be set depending on a thickness of the front panel 14. Further, in a case where the plate-like member mounting device 1 is used as, for example, a lighting apparatus, the height of the rising portions 22 may be set so that the lighting apparatus can be provided between the base portion 21 and the front panel 14.

Each of the panel supporting portions 23 vertically extends, from a front edge portion of the rising portion 22 toward the rising portion 22 provided on the other side, to have a predetermined length so that the panel supporting portions 22 are in parallel with a front surface (elastic member fixed surface) of the base portion 21.

The panel supporting portions 23 have a space therebetween so as to hold the front panel 14 provided between the rising portions 22 of the base panel 11. That is, the space between the panel supporting portions 23 is set so that a width of an opening portion between the panel supporting portions 23 is narrower than a width of the front panel 14. Further, the space between the panel supporting portions 23 is set so that the front panel 14 is provided between the rising portions 22 of the base panel by obliquely inserting the front panel 14 from the opening portion.

That is, the panel supporting portions 23 are located at the locations in front of the front surface (elastic member fixed surface) of the base portion 21, one of the locations being on one side and the other one of the locations being on the other side in the first direction which is in parallel with the front surface (elastic member fixed surface) of the base portion 21, so that the space in the first direction between the panel supporting portions 23 is shorter than a length of the front panel 14 in the first direction.

Each of the guiding portions 24 has a convex curved surface, and is provided on an inner surface of a bending portion between the rising portion 22 and the panel supporting portions 23 of the base panel 11. In a case where a worker obliquely inserts the front panel 14 between the rising portions 22 of the base panel 11 from the opening portion, the guiding portions 24 guide movement of the front panel 14. In order to guide the movement, an outer surface of the guiding portion 24 is formed to be convexly curved. Therefore, a user can easily insert the front panel 14.

Further, the guiding portions 24 regulate the movement of the front panel 14, which is provided between the both rising portion 22 of the base panel 11, in a width direction of the front panel 14 (which is a direction in which the panel supporting portions 23 are provided to face each other).

That is, the guiding portions 24 guide the movement of the front panel 14 in a case where both edge portions of the front panel 14 in the first direction are inserted between the panel supporting portion 23 and the base portion 21 and the movement of the front panel 14 to a predetermined panel location, and locates the front panel at the predetermined panel location in the first direction.

Therefore, a distance between ends of the guiding portions 24, which ends face with each other, is set to be slightly longer than the width of the front panel 14. With this structure, the guiding portions 24 stably hold the front panel 14 at the predetermined panel location between the guiding portions 24 in the base panel 11.

In this embodiment, each of the dampers 12 is formed to have a tubular shape, and is provided on the front surface (elastic member fixed surface) of the base portion 21 so as to be located along the rising portions 22 of the base panel 11 in the longitudinal direction of the base panel 11. The dampers 12 are mounted onto the base portion 21 with use of, for example, an adhesive.

Specifically, the dampers 12 are provided in a direction orthogonal to the first direction on the front surface (elastic member fixed surface) of the base portion 21, and one of the dampers 12 is located at a location corresponding to a location between the panel supporting portions 23 along one of the edge portions of the front panel 14 in the first direction and the other one of the dampers is located at a location corresponding to a location between the panel supporting portions 23 along the other one of the edge portions of the front panel 14 in the first direction.

The dampers 12 press the front panel 14 against the panel supporting portions 23 from a back surface of the front panel 14 in a state in which the front panel 14 is located at the predetermined panel location between the guiding portions 24. That is, the damper 12 stably holds the front panel 14 at the predetermined panel location with (i) a frictional force of a surface abutted against the front panel 14 and (ii) a thrust to the front panel 14.

As to a thrust which is vertically applied to a mounted surface of the dampers 12 (front surface of the base portion 21) in a case where the front panel 14 is inserted into the base portion 21, the dampers 12 are deformed with a first-level thrust which is relatively small until the dampers 12 are shrunk to a predetermined height in the vertical direction. In order to deform the dampers 12 in the vertical direction beyond the predetermined height range, a second-level thrust which is relatively large (which is larger than the first-level thrust) is necessary. That is, the dampers 12 are configured such that, in a case where a thrust in the vertical direction is applied to the dampers 12 to thereby deform the dampers 12 in the vertical direction, a necessary thrust gradually changes, i.e., a necessary thrust to cause the dampers 12 to undergo a first-level deformation within a predetermined height range and a necessary thrust to cause the dampers 12 to undergo the second-level deformation after the first-level deformation are different from each other, and a second-level thrust, which is larger than the first-level deformation to cause the first-level deformation, is necessary to cause the second-level deformation.

The dampers 12 are configured to be easily deformed in the first direction with a thrust in the first direction (lateral direction), and are easily restored to the original state when the thrust in the first direction is removed.

This makes it possible that a worker easily inserts the front panel 14 into the base panel 11 even when the dampers 12 are provided.

In this embodiment, the side panels 13 are provided to respective end surfaces of the base panel 11 in the longitudinal direction, to cover openings of the base panel 11 in the longitudinal direction. This makes it possible to prevent a foreign matter, rainwater, etc. from intruding into the base panel 11 through the end portions in the longitudinal direction of the base panel 11, and to improve appearance of the plate-like member mounting device 1.

The front panel 14 is formed to have a size in accordance with a size of the base panel 11. FIG. 2 shows a simple plate as an example of the front panel 14. The front panel 14 is mounted onto the base panel 11 and is held at a predetermined panel location between the guiding portion 24. In this state, a back surface of the front panel 14 is pressed forward by the dampers 12, and the front surface of the front panel 14 is supported by the panel supporting portions 23, and a location in the width direction is regulated by the guiding portions 24. Therefore, the front panel 14 is stably held at the predetermined panel location.

The following description will specifically discuss the configuration of the dampers 12.

Figure 4:
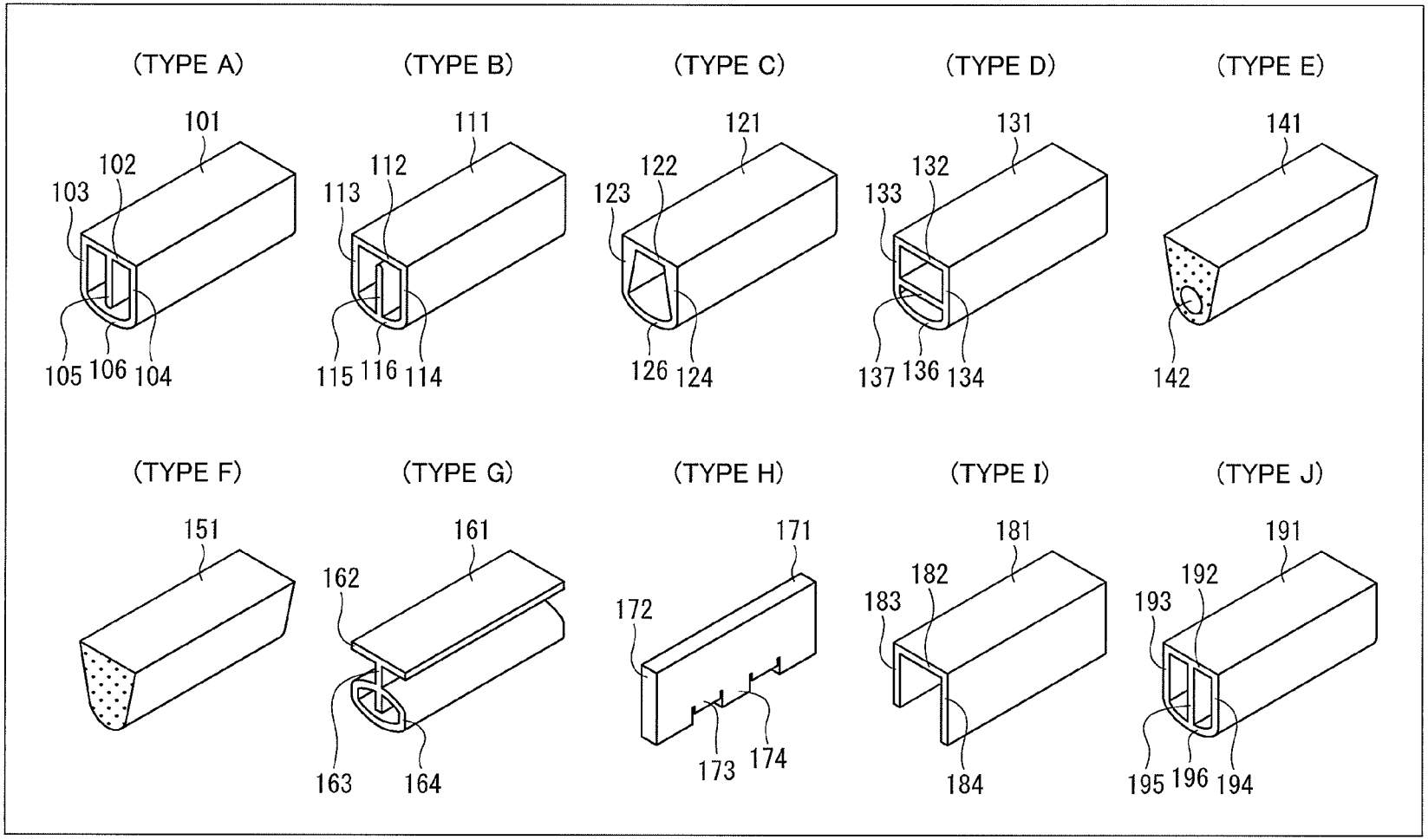
FIG. 4 is a perspective view illustrating longitudinal parts of the elastic members shown in FIG. 3.

Each of the dampers 12 may have various cross-sectional shapes. In this embodiment, for example, a damper of type A shown in FIG. 3 and FIG. 4 is employed as the dampers 12. The damper of type A is suitable as the dampers 12. FIG. 3 is an explanatory view showing examples of the dampers 12 and results of examining whether or not each damper 12 is suitable as the plate-like member mounting device 1. FIG. 4 is a perspective view illustrating longitudinal parts of the dampers 12 of types A through J shown in FIG. 3.

As illustrated in FIG. 4, the damper 12 of type A has first to third longitudinal wall portions 103 to 105 which extend in the vertical direction from a base wall portion 102 having a bonded surface 101 which is to be bonded to the base panel 11. The first and second longitudinal wall portions 103 and 104 are side wall sections provided on both sides of the damper 12, and the third longitudinal wall portion 105 is provided at a location between the first and second longitudinal wall portions 103 and 104. The first to third longitudinal wall portions 103 to 105 are parallel with one another, and are arranged in the first direction. The damper 12 further has a front wall portion 106 which connects front end portions of the first and second longitudinal wall portions 103 and 104. The front wall portion 106 is formed to have a convex curved shape. There is a gap between the front wall portion 106 and a front end portion of the third longitudinal wall portion 105.

The first-level deformation of the damper 12 with a first-level thrust means that the front wall portion 106 is deformed until the front wall portion 106 is abutted against the front end portion of the third longitudinal wall portion 105. In a second-level deformation after the front wall portion 106 is abutted against the third longitudinal wall portion 105, it is necessary to apply a second-level thrust, which is larger than the first-level thrust, to the damper 12 because reactions of the first to third longitudinal wall portion 103 to 105 are applied to a thrust in the vertical direction.

Meanwhile, the damper 12 has a small reaction against a thrust in the first direction which is vertical to an outer surface of the first and second longitudinal wall portion 103 and 104, and is easily deformed in the first direction. The base wall portion 102, the first longitudinal wall portion 103, the second longitudinal wall portion 104, and the front wall portion 106 form a closed tubular shape, so that the damper 12 can be easily restored to the original state in a case where the thrust in the first direction is removed.

In the configuration, a method of mounting the front panel 14 onto the base panel 11 will be discussed with reference to (a) through (c) of FIG. 5 and (a) through (c) of FIG. 6. Note that, in those drawings, the side panels 13 are detached.

(a) of FIG. 5 is an explanatory view illustrating a state in which the front panel 14 is detached from the base panel 11, (b) of FIG. 5 is an explanatory view illustrating an initial state of a work in which one of the edge portions of the front panel 14 is inserted into one of end regions of the base panel 11, and (c) of FIG. 5 is an explanatory view illustrating a working state in which the one of the edge portions of the front panel 14 is inserted into the one of the end regions of the base panel 11. (a) of FIG. 6 is an explanatory view illustrating completion of the work in which the one of the edge portions of the front panel 14 is inserted into the one of the end regions of the base panel from the state of (c) of FIG. 5, (b) of FIG. 6 is an explanatory view illustrating a state in which the both edge portions of the front panel 14 are inserted into the base panel 11, and (c) of FIG. 6 is an explanatory view illustrating completion of locating the front panel 14 at a panel location of the base panel 11.

In order to mount the front panel 14 onto the base panel 11, the following work is carried out in a state in which the front panel 14 is not provided to the base panel 11 as illustrated in (a) of FIG. 5, and the one of the edge portions of the front panel 14 is inserted into the one of the end regions of the base panel 11 as illustrated in (b) of FIG. 5 and (c) of FIG. 5.

Each of the end regions of the base panel 11 is a region surrounded by the base portion 21, the rising portions 22, and the panel supporting portion 23. A worker holds the front panel 14 on a front surface side of the base panel 11 as illustrated in (a) of FIG. 5 and then pushes the one of the edge portions of the front panel 14 into the base portion 21, which results in the initial state of (b) of FIG. 5.

In the state of (b) of FIG. 5, the damper 12 is subjected to the first-level deformation. In this state, the front wall portion 106 of the damper 12 is bended (a curve of the front wall portion 106 is partially planarized), which results in increasing a contact area between the front panel 14 and the front wall portion 106. That is, a friction force of the damper 12 increases with respect to the front panel 14.

From the state of (b) of FIG. 5, the worker pushes the front panel 14 into the one of the end regions of the base panel 11 as illustrated in (c) of FIG. 5. In such an operation, the damper 12 receives a thrust in the first direction (thrust from obliquely above) from the front panel 14, and is then deformed in the first direction. Such deformation in the first direction of the damper 12 easily occurs even if the worker does not apply a large force to the damper 12 because the damper 12 is easily deformed in the first direction.

The one of the edge portions of the front panel 14, which is to be inserted into the one of the end regions of the base panel 11, is inserted into a region between one of the guiding portions 24 and the base portion 21 while being guided by the one of the guiding portion 24.

From the state of (c) of FIG. 5, the worker further pushes the front panel 14 as illustrated in (a) of FIG. 6, and the edge portion of the front panel 14 is abutted against the inner surface of the rising portion 22. Thus, the worker finishes the work in which the one of the edge portions of the front panel 14 is pushed into the one of the end regions of the base panel 11.

Then, the worker pushes the other one of the edge portions of the front panel 14 into the base panel 11 (an operation shown by an arrow of (a) of FIG. 6). After that, as illustrated in (b) of FIG. 6, the worker moves the front panel 14 toward the other one of the end regions of the base panel 11. Such movement is continuously performed until the one of the edge portions of the front panel 14 is not on the one guiding portion 24 and the other one of the edge portions is pushed to be not on the other guiding portion 24.

From the state of (b) of FIG. 6, the worker then moves the front panel 14 toward a front of the base portion 21 and locates the front panel 14 at the panel location as illustrated in (c) of FIG. 6.

The front panel 14 is pressed forward by the dampers 12 which are subjected to the first-level deformation while the front panel 14 is located at the panel location. In this case, the dampers 12 are restored to the original state from the deformation in the first direction. Therefore, the front panel 14 is prevented by the dampers 12 from moving in a direction in parallel with an outer surface of the front panel 14. With this configuration, even in a case where the plate-like member mounting device 1 is shaken from the outside, the front panel 14 is not easily rattled.

As to the movement of the front panel 14 in the direction in parallel with the outer surface of the front panel 14, the movement of the front panel 14 in a direction toward the rising portion 22 (first direction) of the base panel 11 is surely regulated by the guiding portions 24 provided on both sides of the base panel 11. Further, movement of the front panel 14 in a direction toward the side panels 13 is surely regulated by the side panels 13.

In order to detach the front panel 14 from the base panel 11, the work of mounting the front panel 14 onto the base panel 11 (described above) may be inversely performed.

As described above, the work of mounting/detaching the front panel 14 onto/from the base panel 11 can be performed in a state in which the side panels 13 are provided to the base panel 11 or are detached from the base panel 11. Therefore, whether the side panels 13 are detached or mounted may be appropriately selected depending on the circumstances.

The following description will discuss other specific examples of the damper 12 with reference to FIG. 3 and FIG. 4. Note that, in each of the types A through J of FIG. 4, a planar upper surface is a surface to be adhered to the base portion 21 of the base panel 11.

Type A has already been described above as the damper 12.

The type B, similar to the type A, has a bonded surface 111, a base wall portion 112, first to third longitudinal wall portions 113 to 115, and a front wall portion 116. A difference between the type B and the type A is that, in the type B, the third longitudinal wall 115 is formed on an inner surface of the front wall portion 116. Therefore, there is a gap between a back end portion of the third longitudinal wall 115 and the base wall portion 112.

First-level deformation of the type B with a first-level thrust means that the front wall portion 116 is deformed until the front wall portion 116 is abutted against the base wall portion 112. The reason why the type B needs a second-level thrust which is larger than the first-level thrust when the type B is subjected to the second-level deformation, the reason why the type B is easily deformed in the first direction (horizontal direction) with the thrust in the first direction (horizontal direction), and the reason why the type B is easily restored to the original state when the thrust in the first direction (horizontal direction) is removed are identical with those of the type A. Therefore, the type B is suitable as the damper 12.

The type C has a bonded surface 121, a base wall portion 122, first and second longitudinal wall portions 123 and 124, and a front wall portion 126. A difference between the type C and the type A is that the type C does not have a third longitudinal wall portion. Further, other differences between the type C and the type A are that the first and second longitudinal wall portions 123 and 124 in a base wall portion 122 side are thicker than the first and second longitudinal wall portions 103 and 104, a thickness of the first and second longitudinal wall portions 123 and 124 is gradually smaller so that front end portions of the first and second longitudinal wall portions 123 and 124 are thinner than the first and second longitudinal wall portions 123 and 124 in a base wall portion 122 side, and a thickness of the front end portions is substantially equal to that of the first and second longitudinal wall portions 103 and 104.

First-level deformation of the type C with a first-level thrust means that a convex part of the front wall portion 126 is deformed until the convex part is planarized. In second-level deformation, it is necessary to apply a second-level thrust, which is larger than the first-level thrust, to the type C because reactions of the first and second longitudinal wall portions 123 and 124, whose thickness is larger than that of the first and second longitudinal wall portions 103 and 104, are applied. Note that the reason why the type C is easily deformed in the first direction by a thrust in the first direction and the reason why the type C is easily restored to the original state when the thrust in the first direction is removed are identical with those of the type A. Therefore, the type C is suitable as the damper 12.

The type D has a bonded surface 131, a base wall portion 132, first and second longitudinal wall portions 133 and 134, a front wall portion 136, and a lateral wall section 137. A difference between the type D and the type A is that the type D does not have a third longitudinal wall portion and has the lateral wall section 137 which is provided at a backward location of the front wall portion 136 to connect the first longitudinal wall portion 133 and a second longitudinal wall portion 134 with each other.

First-level deformation of the type D with a first-level thrust means that a convex part of the front wall portion 136 is deformed until the convex part is planarized. In second-level deformation, it is necessary to apply a second-level thrust, which is larger than the first-level thrust, to the type D because reactions caused by a closed cross-sectional rectangular shape formed by the base wall portion 132, the first longitudinal wall portion 133, the second longitudinal wall portion 134, and the lateral wall section 137 are applied.

Although the reaction is slightly large because the type D has a lateral wall section 137, the type D is easily deformed in the first direction with a thrust in the first direction. Further, a closed tubular shape is formed by the base wall portion 132, the first longitudinal wall portion 133, the second longitudinal wall portion 134, the front wall portion 136, and the lateral wall section 137, so that the type D is easily restored to the original state when the thrust in the first direction is removed. Therefore, the type D is also suitable as the damper 12.

The type E has a bar shape, and has a cross-section of an isosceles triangle whose base is a bonded surface 141 of the base panel 11. An apex portion of the isosceles triangle is rounded. A hole 142 is secured in the vicinity of the apex portion. Because of such a cross-sectional shape, a thrust for causing deformation in the vertical direction is relatively small at first, and gradually increases as the deformation becomes large. Therefore, a step-by-step change in thrust, such as a first-level thrust and a second-level thrust, does not occur in the type E. Therefore, the type E is unsuitable as the damper 12.

Note that the type E has a large reaction against a thrust in the first direction and therefore is not easily deformed in the first direction. The type E is satisfactorily restored to the original state when the thrust in the first direction is removed.

The type F, similar to the type E, has a cross-section of an isosceles triangle whose base is a bonded surface 151 of the base panel 11 and an apex portion of the isosceles triangle is rounded. Note, however, that the type F does not have a hole 142. Therefore, a step-by-step change in a thrust to cause deformation in the vertical direction, such as a first-level thrust and a second-level thrust, does not occur in the type F, as in the case of the type E. Therefore, the type F is unsuitable as the damper 12.

Note that the type F is not easily deformed in the first direction with the thrust in the first direction, meanwhile, is satisfactorily restored to the original state when the thrust in the first direction is removed.

The type G has a longitudinal wall portion 163 which is protruded vertically from a base wall portion 162 having a bonded surface 161 of the base panel 11. An oval tubular portion 164 is provided to a front portion of the longitudinal wall portion 163. Specifically, the longitudinal wall portion 163 extends through a back wall of the oval tubular portion 164 toward a front wall of the oval tubular portion 164. Therefore, there is a gap between a front end portion of the longitudinal wall portion 163 and a front wall of the oval tubular portion 164.

First-level deformation of the type G with a first-level thrust means that the oval tubular portion 164 is deformed until the front wall of the oval tubular portion 164 is abutted against a front end portion of the longitudinal wall portion 163. In second-level deformation after the oval tubular portion 164 is abutted against the longitudinal wall portion 163, it is necessary to apply a second-level thrust, which is larger than the first-level thrust, to the type G because a reaction of the longitudinal wall portion 163 is applied to a thrust in the vertical direction.

Meanwhile, the type G has a small reaction against the thrust in the first direction and is therefore easily deformed in the first direction. In contrast, because the type G has such a shape that only a single longitudinal wall portion 163 supports the oval tubular portion 164, the type G is not satisfactorily restored to the original state when the thrust in the first direction is removed. Therefore, the type G is unsuitable as the damper 12.

The type H has a single longitudinal wall portion 172 which vertically extends. A back end surface of the longitudinal wall portion 172 serves as a bonded surface 171 of the base panel 11. The longitudinal wall portion 172 has back longitudinal wall portions 173 and front longitudinal wall portions 174, and the front longitudinal wall portion 174 is formed by cutting out a front end portion of the longitudinal wall portion 172 at a predetermined interval. Therefore, the front longitudinal wall portions 174 are formed in the front end portion of the back longitudinal wall portion 173 at a predetermined interval along a longitudinal direction of the longitudinal wall portion 172.

First-level deformation of the type H with a first-level thrust means that, for example, the front longitudinal wall portions 174 are bent on right or left side. In order to cause second-level deformation after the first-level deformation, it is necessary to apply a second-level thrust, which is larger than the first-level thrust, to the type H because a reaction of the back longitudinal wall portion 173, which is larger than a reaction of the front longitudinal wall portion 174, is applied to a thrust in the vertical direction.

Meanwhile, the type H has a small reaction against the thrust in the first direction, and is therefore easily deformed in the first direction. In contrast, because the type H has a shape constituted by merely one longitudinal wall portion 172, the type H is not satisfactorily restored to the original state when the thrust in the first direction is removed. Therefore, the type H is unsuitable as the damper 12.

The type I has first and second longitudinal wall portions 183 and 184 that are provided at both ends of a base wall portion 182 and extend vertically from a base wall portion 182 having a bonded surface 181 of the base panel 11. The second longitudinal wall portion 184 is vertically longer than the first longitudinal wall portion 183.

First-level deformation of the type I, caused by a first-level thrust, means that only the second longitudinal wall portion 184, which is vertically longer than the first longitudinal wall portion 183, is deformed. In order to cause second-level deformation after the first-level deformation, it is necessary to apply a second-level thrust, which is larger than the first-level thrust, to the type I because reactions of the first and second longitudinal wall portions 183 and 184 are applied.

Meanwhile, the type I has a small reaction against the thrust in the first direction, and is therefore easily deformed in the first direction. In contrast, because the first and second longitudinal wall portions 183 and 184 are independently formed, the type I is not satisfactorily resorted to the original state when the thrust in the first direction is removed. Therefore, the type I is unsuitable as the damper 12.

The type J is similar to the type A and the type B in cross-sectional shape, and has a bonded surface 191, a base wall portion 192, first to third longitudinal wall portions 193 to 195, and a front wall portion 196. A difference between the type J and types A and B is that the type J has the third longitudinal wall portion 195 which is connected to the base wall portion 192 and the front wall portion 196 and has no gap between the third longitudinal wall portion 195 and the base wall portion 192 or between third longitudinal wall portion 195 and the front wall portion 196.

Because the type J has the cross-sectional shape as described above, a thrust necessary for deforming the type J in the vertical direction is substantially unchanged, that is, a step-by-step change such as a first-level thrust or a second-level thrust does not occur. Therefore, the type J is unsuitable as the damper 12.

Note that, as in the case of the type A and the type B, the type J is easily deformed in first direction with the thrust in the first direction, and is easily restored to the original state when the thrust in the first direction is removed.

The plate-like member mounting device 1 of this embodiment has such a simple configuration that the dampers 12 are provided on the base panel 11 as described above, so that the front panel 14 serving as a plate-like member can be easily mounted onto the base panel 11 and also easily detached from the base panel 11.

In order to detach the front panel 14 from the base panel 11, as illustrated in (a) of FIG. 6 (or (c) of FIG. 5), it is necessary to push one of the edge portions of the front panel 14 into an inner surface location of the rising portion 22 and deform the damper 12 in the first direction. Therefore, the state illustrated in (a) of FIG. 6 (or (c) of FIG. 5) is not easily caused by an earthquake which shakes the whole plate-like member mounting device 1. With this configuration, the front panel 14 is not easily fallen from the base panel 11 because of an earthquake, that is, the plate-like member mounting device 1 has an enough ability to withstand earthquakes.

The front panel 14 is formed to have a planar shape in the above Embodiment 1, however, panels which have been subjected to various kinds of process may be appropriately used as the front panel 14. For example, cutout portions may be formed at the edge portions of the front panel 14 on the front surface side of the front panel 14, which edge portions are supported by the panel supporting portion 23, so that the front surface of the front panel 14 to be flush with a front surface of the panel supporting portions 23.

The plate-like member is not limited to the front panel 14 for use in a sign or an advertising panel, and examples of the plate-like member encompass panel cover members in lighting apparatuses or various panel display devices. The plate-like member may also be a flat lighting apparatus such as an organic EL lighting apparatus whose plate-like member emits light.

Note that, in a case where the front panel 14 is used as a sign or an advertising panel, the plate-like member mounting device 1 is effectively used when the plate-like member mounting device 1 is provided, particularly, in a station, a passageway where many people come and go, or other places and the front panel 14 is replaced with another one within a short-term cycle, because the front panel 14 can be easily mounted and detached.

In a case where the front panel 14 is a panel cover member of a lighting apparatus, a main body of the lighting apparatus may be provided between the base panel 11 and the front panel 14. In a case where the front panel 14 is a panel display device, a device(s) or a part(s) for driving the panel display device may be provided between the base panel 11 and the front panel 14.

[Embodiment 2]

The following description will discuss another embodiment of the present invention with reference to drawings.

The plate-like member mounting device 1, in which two dampers 12 are provided on the base panel 11, has been described in Embodiment 1. However, the plate-like member mounting device 1 may be configured to have only a single damper 12 on the base panel 11.

For example, as illustrated in (a) of FIG. 7, in a case of a plate-like member mounting device 2 in which a single damper 12 is provided on a base panel 11, the damper 12 is located in a middle portion between the rising portions 22 of the base portion 21 of the base panel 11. That is, the damper 12 is provided in the middle portion of the front panel 14 in the first direction in a back surface (elastic member fixed surface) of the front panel 14, so as to extend in a direction orthogonal to the first direction. In this case, an opening 21*a* is not provided at a location of the base portion 21 where the damper 12 is located. The rest of the configuration of the plate-like member mounting device 2 is similar to that of the plate-like member mounting device 1.

In the configuration, a method of mounting the front panel 14 onto the base panel 11 will be described with reference to (a) of FIG. 7 to (c) of FIG. 7 and (a) of FIG. 8 to (c) of FIG. 8.

A work illustrated in (a) of FIG. 7 through (c) of FIG. 7 corresponds to the work of (a) of FIG. 5 through (c) of FIG. 5 which is performed by a worker, and a work illustrated in (a) of FIG. 8 through (c) of FIG. 8 corresponds to the work of (a) of FIG. 6 through (c) of FIG. 6 which is performed by a worker. Therefore, the following description will discuss only differences between Embodiment 1 and Embodiment 2.

From the state of (a) of FIG. 7, in a case where the front panel 14 is mounted onto the base panel 11, first, one of edge portions of the front panel 14 is inserted into one of end regions of the base panel 11 as illustrated in (b) of FIG. 7 and (c) of FIG. 7.

In the states of (b) of FIG. 7 and (c) of FIG. 7, the front panel 14 is not abutted against the damper 12, and therefore, unlike the states of (b) of FIG. 5 and (c) of FIG. 5, the damper 12 is not deformed.

From a state in which the one of the edge portions of the front panel 14 is abutted against one of inner surfaces of rising portions 22 as illustrated in (a) of FIG. 8, a worker pushes the other one of the edge portions of the front panel 14 into the base panel 11 (an operation indicated by an arrow of (a) of FIG. 8). In the middle of this work, the front panel 14 is abutted against the damper 12, and the damper 12 is subjected to first-level deformation.

Thereafter, the worker moves the front panel 14 toward the other one of the end regions of the base panel 11 as illustrated in (b) of FIG. 8. By moving the front panel 14 as described above, the damper 12 receives a thrust in the first direction (thrust from obliquely above) from the front panel 14, and is deformed in the first direction. After that, the front panel 14 is located at a panel location as illustrated in (c) of FIG. 8.

Functions of the plate-like member mounting device 2 in a state in which the front panel 14 is located at the panel location are similar to those of the plate-like member mounting device 1. A mode to which the plate-like member mounting device 2 is applied is similar to that of the plate-like member mounting device 1.

The plate-like member mounting devices 1 and 2, in which the damper(s) 12 is(are) provided to the base panel 11, have been described in the above Embodiments 1 and 2. In those Embodiments, various front panels 14 can be selected and used. Therefore it can be considered that both the plate-like member mounting devices 1 and 2 essentially need the base panel 11 and the damper(s) 12.

[Embodiment 3]

The following description will discuss still another embodiment of the present invention with reference to drawings.

In the above plate-like member mounting devices 1 and 2, the damper(s) 12 may be provided to a back surface (elastic member fixed surface) of the front panel 14 instead of being provided to the base panel 11. The following description will discuss such a plate-like member mounting device.

FIG. 9 is an explanatory view illustrating a state in which, in a plate-like member mounting device 3, a front panel 14 providing two dampers 12 is mounted onto a base panel 11. FIG. 10 is an explanatory view illustrating a state in which, in a plate-like member mounting device 4, a front panel 14 providing a single damper 12 is mounted onto a base panel 11.

In each of the plate-like member mounting devices 3 and 4 of FIG. 9 and FIG. 10, the front panel 14 is located at the panel location. In each of these states, the damper(s) 12 is(are) abutted against (is in contact with pressure to) the front surface of the base portion 21, and is therefore subjected to first-level deformation. Therefore, the front panel 14 is pressed forward by the damper(s) 12. With this, the front panel 14 is prevented by the damper(s) 12 from moving in a direction in parallel with an outer surface of the front panel 14, and therefore the front panel 14 is stably held, as in a case of the plate-like member mounting devices 1 and 2.

The front panel 14 can be mounted onto and detached from the base panel 11 in each of the plate-like member mounting devices 3 and 4 in the same way as the plate-like member mounting devices 1 and 2. Further, a function(s) of the plate-like member mounting devices 3 and 4 is(are) similar to that(those) of the plate-like member mounting devices 1 and 2.

In a case of the plate-like member mounting devices 3 and 4, the front panel 14 is necessary because the front panel 14 provides the damper(s) 12. Therefore it can be considered that each of the plate-like member mounting devices 3 and 4 essentially needs the base panel 11 and the damper(s) 12.

The dampers 12, each of which is a single elongated damper, have been described in the Embodiments 1 through 3, however, a plurality of dampers 12 each having a short length may be provided in a line.

Further, the plate-like member mounting device may be configured such that (i) the elastic member has third longitudinal wall portion, which is in parallel with the first and second longitudinal wall portions, between the first longitudinal wall portion and the second longitudinal wall portion, (ii) one of end portions of the third longitudinal wall portion, which is vertical to the elastic member fixed surface, is connected to the base wall portion or the front wall portion, and (iii) there is a gap between the other one of the end portions, which is a non-connection section, and the base wall portion or between the other one of the end portions and the front wall portion.

According to the above configuration, in a case where a first-level thrust is applied to the elastic member, a front wall portion is subjected to first-level deformation. In second-level deformation after the first-level deformation, the first through third longitudinal wall portions are deformed with a thrust in the vertical direction, and, in order to deform the first through third longitudinal wall portions, it is necessary to apply a second-level thrust, which is larger than the first-level thrust, to the elastic member. Further, in a case where a thrust in the first direction, which is a direction vertical to side surfaces of the first through third longitudinal wall portions, is applied to the elastic member, the elastic member can be easily deformed in the first direction. The elastic member has the above configuration, so that the plate-like member can be easily mounted and detached, and the elastic member having the above configuration is further preferably used in a plate-like member mounting device for appropriately holding the plate-like member which is located at a predetermined location.

A plate-like member mounting device of the present invention, on which a plate-like member is mounted, the plate-like member mounting device includes: a base member; and at least one elastic member, wherein: the base member has a base portion and supporting portions; the base portion has an elastic member fixed surface to which the at least one elastic member is fixed; the supporting portions (I) are located on both sides of the elastic member fixed surface in a first direction which is in parallel with the elastic member fixed surface, the supporting portions being located in front of the elastic member fixed surface so as to have a space therebetween in the first direction, which space is shorter than a length of the plate-like member in the first direction, and (II) support the plate-like member from a front surface side thereof; and the at least one elastic member (i) is fixed to the elastic member fixed surface, (ii) is subjected to first-level deformation in the vertical direction in a case where the at least one elastic member receives a first-level thrust of a vertical direction, (iii) after the first-level deformation, is further subjected to second-level deformation in the vertical direction in a case where the at least one elastic member receives a second-level thrust in the vertical direction, which second-level thrust is larger than the first-level thrust, (iv) is deformed in the first direction in a case where the at least one elastic member receives a thrust in the first direction, and (v) supports the plate-like member from a back surface side of the plate-like member while the at least one elastic member is being subjected to the first-level deformation.

Further, a plate-like member mounting device of the present invention includes: a base member; at least one elastic member; and a plate-like member, wherein: a back surface of the plate-like member serves as an elastic member fixed surface; the base member has a base portion and supporting portions; the base portion has an elastic member abutted surface to which a front end surface of the at least one elastic member is abutted; the supporting portions (I) are located on both sides of the elastic member abutted surface in a first direction which is in parallel with the elastic member abutted surface, the supporting portions being located in front of the elastic member abutted surface so as to have a space therebetween in the first direction, which space is shorter than a length of the plate-like member in the first direction, and (II) support the plate-like member from a front surface side thereof; and the at least one elastic member (i) is fixed to the elastic member fixed surface of the plate-like member, (ii) is subjected to first-level deformation in the vertical direction in a case where the at least one elastic member receives a first-level thrust of a vertical direction, (iii) after the first-level deformation, is further subjected to second-level deformation in the vertical direction in a case where the at least one elastic member receives a second-level thrust in the vertical direction, which second-level thrust is larger than the first-level thrust, (iv) is deformed in the first direction in a case where the at least one elastic member receives a thrust in the first direction, and (v) is abutted against the elastic member abutted surface and supports the plate-like member from a back surface side of the plate-like member while the at least one elastic member is being subjected to the first-level deformation.

According to the above configuration, in order to mount the plate-like member, first, one of edge portions of the plate-like member in the first direction is headed to the base portion and the one of the edge portions is inserted between the one of the supporting portions and the base portion of the base member. Then, the plate-like member is reached to a location where the other one of the edge portions is not abutted against the other one of the supporting portions, and the other one of the edge portions of the plate-like member is headed to the base portion and the other one of the edge portions is inserted between the other one of the supporting portions of the base member and the base portion. Thus, it is possible to provide the plate-like member at a predetermined location where the front surface of the plate-like member is supported by the supporting portions on the both sides.

In a work of moving the plate-like member in the first direction in order to mount the plate-like member as described above, a back surface of the plate-like member or an elastic member abutted surface of the base portion is abutted against the elastic member, however, in a case where a thrust in the first direction is applied to the elastic member, the elastic member is deformed in the first direction. Therefore, it is possible to easily perform the work. It is further possible to easily detach the plate-like member by performing inversely the work. With this simple configuration, the plate-like member can be easily mounted and detached in the present invention.

In a case where the plate-like member is located at a predetermined location, the elastic member is restored to an original state from the deformation in the first direction. Therefore, a front surface of the plate-like member is supported by supporting portions on the both sides, and the back surface is supported by the plate-like member which is subjected to first-level deformation. This makes it possible to steadily hold the plate-like member.

The plate-like member mounting device, may include guiding members, each having a convex curved surface, which are provided on back surfaces of the supporting portions, respectively, of the base member, the guiding members guiding (a) movement of the plate-like member in a case where edge portions in the first direction of the plate-like member are inserted between the supporting portions and the base portion of the base member, and (b) movement of the plate-like member to a predetermined location, and locating the plate-like member in the first direction at the predetermined location.

According to the above configuration, in order to mount the plate-like member, the guiding members guide the movement of the plate-like member to insert the edge portions of the plate-like member in the first direction between the supporting portions of the base member and the base portion and the movement of the plate-like member to a predetermined location. Therefore, the plate-like member can be smoothly located at a predetermined location. Further, the plate-like member is located at a location in the first direction by the guiding members, so that the plate-like member can be surely held at the location.

In the plate-like member mounting device, the elastic members may be provided on the elastic member fixed surface so as to be provided along a direction orthogonal to the first direction, and one(s) of the elastic members being located at a location between the supporting portions, the location corresponding to a location along one edge portion in the first direction of the plate-like member, and the other one(s) of the elastic members being located at a location between the supporting portions, the location corresponding to a location along the other edge portion in the first direction of the plate-like member.

With this simple configuration in which the plate-like member mounting device includes (a) the base member including the base portion and the supporting portion and (b) the two elastic members, the plate-like member mounting device appropriately holds the plate-like member.

In the plate-like member mounting device, the at least one elastic member may be provided in a direction orthogonal to the first direction on the elastic member fixed surface, the at least one elastic member being located at a location corresponding to a middle portion in the first direction of the plate-like member.

With this simple configuration in which plate-like member mounting device includes (a) the base member including the base portion and the supporting portions and (b) a single elastic member, the plate-like member mounting device appropriately holds the plate-like member.

In the plate-like member mounting device, the at least one elastic member may have (i) a base wall portion which is fixed on the elastic member fixed surface, (ii) first and second longitudinal wall portions which are extended from the base wall portion in a direction vertical to the elastic member fixed surface and) are arranged in parallel with each other in the first direction, and (iii) a front wall portion which is formed to connect front end portions of the first and second longitudinal wall portions with each other and is curved to protrude forward; and the base wall portion, the first and second longitudinal wall portions, and the front wall portion may be circularly connected with one another to have a tubular shape having a space inside thereof.

According to the above configuration, a front wall portion of the elastic member is subjected to first-level deformation with a first-level thrust. Further, in the second-level deformation after the first-level deformation, it is necessary to apply a second-level thrust, which is larger than the first-level thrust, to the elastic member because the first and second longitudinal wall portions are deformed with a thrust in the vertical direction. Further, in a case where a thrust in the first direction which is a direction vertical to side walls of the first and second longitudinal wall portions is applied, the elastic member is easily deformed in the first direction. Therefore, the plate-like member of the elastic member having the above configuration is easily mounted and detached, and is suitable as a plate-like member mounting device for appropriately holding the plate-like member located at a predetermined location.

The present invention is not limited to the description of the embodiments above, and can be modified in numerous ways by a skilled person as long as such modification falls within the scope of the claims. An embodiment derived from a proper combination of technical means disclosed in different embodiments is also encompassed in the technical scope of the present invention.

INDUSTRIAL APPLICABILITY

The present invention can be used to mount a cover panel of a lighting apparatus, an advertising sign, and other various kinds of plate-like members.

REFERENCE SIGNS LIST

1,2,3,4 plate-like member mounting device
11 base panel (base member)
12 damper (elastic member)
13 side panel
14 front panel (plate-like member)
21 base portion
22 rising portions
23 panel supporting portion (supporting portion)
24 guiding portion (guiding member)
101, 111, 121, 131 bonded surface
102, 112, 122, 132 base wall portion
103, 113, 123, 133 first longitudinal wall portion
104, 114, 124, 134 second longitudinal wall portion
105, 115 third longitudinal wall portion
106, 116, 126, 136 front wall portion
137 lateral wall section

The invention claimed is:

1. A generally plate shaped member mounting device onto which a generally plate shaped member is mounted, the generally plate shaped member mounting device comprising:

a base member; and a first elastic member, wherein:

the base member has a base portion and a plurality of supporting portions;

the base portion has an elastic member fixed surface to which the first elastic member is fixed;

the elastic member fixed surface is located between two of the plurality of supporting portions;

the two supporting portions of the plurality of supporting portions each extend along a first direction which is parallel to the elastic member fixed surface;

the two supporting portions of the plurality of supporting portions are each located adjacent to the elastic member fixed surface with a distance between each of the two supporting portions and the elastic member fixed surface, respectively, being shorter than a length of the generally plate shaped member along the first direction;

the two supporting portions of the plurality of supporting portions being configured to support the generally plate shaped member from a front surface side of the generally plate shaped member;

the first elastic member (i) is subjected to first-level deformation in a vertical direction vertical to the elastic member fixed surface in a case where the first elastic member receives a first-level thrust in the vertical direction, (ii) after the first-level deformation, is further subjected to second-level deformation in the vertical direction in a case where the first elastic member receives a second-level thrust in the vertical direction, which second-level thrust is larger than the first-level thrust, (iii) is deformed in the first direction in a case where the first elastic member receives a thrust in the first direction, and (iv) in a case where an edge portion of the generally plate shaped member is inserted between the base member and one of the plurality of supporting portions in the first direction and then the thrust in the first direction is removed, the first elastic member is restored from the deformation in the first direction and supports the generally plate shaped member from a back surface side of the generally plate shaped member while the first elastic member is being subjected to the first-level deformation;

the first elastic member includes (i) a base wall portion which is fixed on the elastic member fixed surface and (ii) a longitudinal wall portion which is extended from the base wall portion in the vertical direction vertical to the elastic member fixed surface; and the first direction is a direction perpendicular to an outer surface of the longitudinal wall portion.

2. The generally plate shaped member mounting device as set forth in claim 1, further comprising guiding members, each having a convex curved surface, which are provided on back surfaces of the plurality of supporting portions, respectively, of the base member, the guiding members guiding (a) movement of the generally plate shaped member in a case where edge portions of the generally plate shaped member are inserted between the plurality of supporting portions and the base portion of the base member, and (b) movement of the generally plate shaped member to a predetermined location, and locating the generally plate shaped member in the first direction at the predetermined location.

3. The generally plate shaped member mounting device as set forth in claim 1, further comprising a second elastic member, wherein the first and second elastic members are provided on the elastic member fixed surface so as to extend along a direction orthogonal to the first direction, and a first one of the first and second elastic members being positioned closer to one of the two supporting portions of the plurality of supporting portions than an other of the two supporting portions of the plurality of supporting portions, and a second one of the first and second elastic members being positioned closer to the other of the two supporting portions of the plurality of supporting portions.

4. The generally plate shaped member mounting device as set forth in claim 1, wherein the first elastic member extends in a direction orthogonal to the first direction, the first elastic member being located at a location corresponding to a middle portion of the generally plate shaped member.

5. The generally plate shaped member mounting device as set forth in claim 1, wherein:

the first elastic member has (i) first and second longitudinal wall portions which extend from the base wall portion in the vertical direction vertical to the elastic member fixed surface and are arranged parallel to each other in the first direction, and (ii) a front wall portion which connects front end portions of the first and second longitudinal wall portions with each other and is curved to protrude forward; and the base wall portion, the first and second longitudinal wall portions, and the front wall portion are circularly connected with one another to have a tubular shape having a space inside thereof.

6. A generally plate shaped member mounting device, comprising:

a base member;

a first elastic member; and a generally plate shaped member having a front surface and a back surface, wherein:

the first elastic member is fixed to an elastic member fixed surface on the back surface of the generally plate shaped member;

the base member has a base portion and a plurality of supporting portions;

the base portion has an elastic member abutting surface which the first elastic member abuts;

the elastic member abutting surface is located between two of the plurality of supporting portions;

the two supporting portions of the plurality of supporting portions each extend along a first direction which is parallel to the elastic member abutting surface;

the two supporting portions of the plurality of supporting portions are each located adjacent to the elastic member abutting surface with a distance between each of the two supporting portions and the elastic member abutting surface, respectively, being shorter than a length of the generally plate shaped member along the first direction;

the two supporting portions of the plurality of supporting portions being configured to support the generally plate shaped member from a front surface side of the generally plate shaped member;

the first elastic member (i) is subjected to first-level deformation in a vertical direction vertical to the elastic member fixed surface in a case where the first elastic member receives a first-level thrust in the vertical direction, (ii) after the first-level deformation, is further subjected to second-level deformation in the vertical direction in a case where the first elastic member receives a second-level thrust in the vertical direction, which second-level thrust is larger than the first-level thrust, (iii) is deformed in the first direction in a case where the first elastic member receives a thrust in the first direction, and (iv) in a case where an edge portion of the generally plate shaped member is inserted between the base member and one of the plurality of supporting portions in the first direction and then the thrust in the first direction is removed, the first elastic member is restored from the deformation in the first direction and abuts the elastic member abutting surface and supports the generally plate shaped member from a back surface side of the generally plate shaped member while the first elastic member is being subjected to the first-level deformation;

the first elastic member includes (i) a base wall portion which is fixed on the plate like member and (ii) a longitudinal wall portion which is extended from the base wall portion in the vertical direction vertical to the back surface of the generally plate shaped member; and the first direction is a direction perpendicular to an outer surface of the longitudinal wall portion.

7. The generally plate shaped member mounting device as set forth in claim 6, further comprising guiding members, each having a convex curved surface, which are provided on back surfaces of the plurality of supporting portions, respectively, of the base member, the guiding members guiding (a) movement of the generally plate shaped member in a case where edge portions of the generally plate shaped member are inserted between the plurality of supporting portions and the base portion of the base member, and (b) movement of the generally plate shaped member to a predetermined location, and locating the generally plate shaped member in the first direction at the predetermined location.

8. The generally plate shaped member mounting device as set forth in claim 6, further comprising a second elastic member, wherein the first and second elastic members are provided on the elastic member fixed surface so as to extend along a direction orthogonal to the first direction, and a first one of the first and second elastic members being positioned closer to one of the two supporting portions of the plurality of supporting portions than an other of the two supporting portions of the plurality of supporting portions, and a second one of the first and second elastic members being positioned closer to the other of the two supporting portions of the plurality of supporting portions.

9. The generally plate shaped member mounting device as set forth claim 6, wherein the first elastic member extends in a direction orthogonal to the first direction, the first elastic member being located at a location corresponding to a middle portion of the generally plate shaped member.

10. The generally plate shaped member mounting device as set forth in claim 6, wherein:

the first elastic member has (i) first and second longitudinal wall portions which extend from the base wall portion in the vertical direction vertical to the elastic member fixed surface and are arranged parallel to each other in the first direction, and (ii) a front wall portion which is formed to connect front end portions of the first and second longitudinal wall portions with each other and is curved to protrude forward; and the base wall portion, the first and second longitudinal wall portions, and the front wall portion are circularly connected with one another to have a tubular shape having a space inside thereof.

* * * * *